US009200389B2

(12) United States Patent
Kobayashi

(10) Patent No.: US 9,200,389 B2
(45) Date of Patent: Dec. 1, 2015

(54) BRAIDED WIRE MANUFACTURING METHOD AND BRAIDED WIRE MANUFACTURING APPARATUS

(71) Applicant: SUMITOMO WIRING SYSTEMS, LTD., Mie (JP)

(72) Inventor: Eiji Kobayashi, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 14/376,030

(22) PCT Filed: Jul. 25, 2013

(86) PCT No.: PCT/JP2013/070148

§ 371 (c)(1),
(2) Date: Jul. 31, 2014

(87) PCT Pub. No.: WO2014/024689

PCT Pub. Date: Feb. 13, 2014

(65) Prior Publication Data

US 2015/0033933 A1 Feb. 5, 2015

(30) Foreign Application Priority Data

Aug. 8, 2012 (JP) ..... 2012-175492

(51) Int. Cl.

| | |
|---|---|
| ***D04C 3/48*** | (2006.01) |
| ***H01B 13/26*** | (2006.01) |
| ***D04C 1/12*** | (2006.01) |
| ***D04C 1/02*** | (2006.01) |

(Continued)

(52) U.S. Cl.

CPC .. *D04C 3/48* (2013.01); *D04C 1/02* (2013.01); *D04C 1/06* (2013.01); *D04C 1/12* (2013.01); *D04C 3/40* (2013.01); *H01B 13/2606* (2013.01)

(58) Field of Classification Search

CPC ..... D04C 3/48
USPC ..... 87/35
See application file for complete search history.

(56) References Cited

U.S. PATENT DOCUMENTS

| | | | | |
|---|---|---|---|---|
| 2,175,401 | A * | 10/1939 | Koppel | 87/29 |
| 3,099,932 | A * | 8/1963 | Ege et al. | 87/1 |
| 3,124,032 | A * | 3/1964 | Webster et al. | 87/1 |

(Continued)

FOREIGN PATENT DOCUMENTS

| | | |
|---|---|---|
| JP | 51-2992 | 1/1976 |
| JP | 11-502269 | 2/1999 |

(Continued)

*Primary Examiner* — Shaun R Hurley
(74) *Attorney, Agent, or Firm* — Greenblum & Bernstein, P.L.C.

(57) ABSTRACT

Provide is a braided wire manufacturing method and a braided wire manufacturing apparatus which can produce a braided wire accurately braided without distortion. In a braided wire manufacturing apparatus, a plurality of conductive wires fed from a wire feeding mechanism are braided into a braided wire from a convergence position after passing through a mesh hole die, and the braided wire after passing along a guide roller is wound up using a capstan unit. The guide roller has a guide width for horizontal direction restriction so that movement of the braided wire in the horizontal direction falls within a predetermined restriction width from an ideal center position. The guide roller is provided at a height of a braid pitch of the braided wire in the perpendicular direction from the convergence position as a second feature.

3 Claims, 4 Drawing Sheets

(51) Int. Cl.
*D04C 1/06* (2006.01)
*D04C 3/40* (2006.01)

(56) References Cited

U.S. PATENT DOCUMENTS 3,653,295 A * 4/1972 Pintard ..... 87/1
4,333,380 A * 6/1982 Kozlowski ..... 87/6
4,802,398 A * 2/1989 Champlin et al. ..... 87/8
4,976,812 A * 12/1990 McConnell et al. ..... 156/148
5,146,835 A * 9/1992 McConnell et al. ..... 87/1
5,320,696 A * 6/1994 McConnell et al. ..... 156/148
5,417,138 A * 5/1995 Morris et al. ..... 87/31
5,910,204 A 6/1999 Carrara
6,598,510 B1 * 7/2003 Kim ..... 87/33
6,679,152 B1 * 1/2004 Head et al. ..... 87/9
2013/0214079 A1 * 8/2013 Kobayashi et al. ..... 242/366.3

FOREIGN PATENT DOCUMENTS

JP 2004-311330 11/2004
JP 3909441 4/2007
JP 2008-019518 1/2008

* cited by examiner

BRAIDED WIRE MANUFACTURING METHOD AND BRAIDED WIRE MANUFACTURING APPARATUS

TECHNICAL FIELD

This invention relates to a braided wire manufacturing method and a braided wire manufacturing apparatus in which a braided wire is manufactured by braiding a plurality of wire members.

BACKGROUND ART

Recently, there is a tendency in the automotive industry for a remarkable increase of HEVs (Hybrid Electric Vehicles) and EVs (Electric Vehicles) (which are hereinafter abbreviated collectively as "HEVs/EVs"), for an approach to be eco-friendly and fuel-efficient.

Under such a situation, wire harnesses for providing electrical connection between an inverter (INV) serving as a power converter and a motor generator (MG) serving as both a motor and a generator are shielded against noise in HEVs/EVs. For such shielding, a braided wire may be used as a shielding layer.

As a technique for manufacturing a braided wire serving as a shielding layer of an electric wire, the technique disclosed in Patent Document 1 can be mentioned, for example. In Patent Document 1, a shielding member unwound from a bobbin is drawn by a capstan that winds up a wire member so as to be fed to a synthetic resin extrusion molding machine, as a braided wire that is braided into a tubular shape around a shielded electric wire.

Further, examples of other braided wires include a braided wire classified as "number of strikes 44, number of takings 4, element wire diameter 0.26 mm". That is, there is a braided wire (which may hereinafter be abbreviated simply as "the aforementioned type of braided wire") obtained by braiding a wire member that is composed of four TAs (tin coated annealed copper wires), has a diameter of 0.26 mm, and is unwound from each of 44 bobbins. The aforementioned type of braided wire is manufactured as a bulk shielding braided wire in the form of a single part, independently of a shielded electric wire. That is, a braided wire braided into a hollow tubular shape is manufactured, and the electric wire is inserted into the hollow braided wire, as a result of which the bulk shielding braided wire can shield the electric wire.

The aforementioned type of braided wire can be manufactured by, using a take-up capstan, winding up a braided wire obtained by collecting 44 strands (four ends per carrier, TA, 0.26) that are fed from a carrier section and passing them through a hole die.

CITATION LIST

Patent Documents

Patent Document 1: JP 2004-311330A

SUMMARY

Technical Problem

However, the bulk shielding braided wire has an unstable cross sectional shape due to being a hollow braided wire as mentioned above, and therefore the bulk shielding braided wire tends to have distortion.

If distortion occurs in production of the bulk shielding braided wire, when the bulk shielding braided wire that is the finished product is cut in a processing stage, the bulk shielding braided wire has an angled cut section, thereby causing an increase in contact resistance, when the end of the braided wire is fixed, for example, to a grounding ring member by crimping or the like, following a reduction in contact area or a deterioration in fixation strength between the two, which has been a problem.

This invention has been accomplished in order to solve the aforementioned problem, and aims to provide a braided wire manufacturing method and a braided wire manufacturing apparatus which enable a braided wire that is accurately braided without distortion to be manufactured.

Solution to Problem

A braided wire manufacturing method according to a first aspect of the invention is a method in which, after obtaining a braided wire by braiding a plurality of wire members, the braided wire is wound up using a predetermined take-up unit, the method including: (a) a step of feeding the plurality of wire members from a predetermined wire feeding mechanism toward a predetermined hole die; (b) a step of passing the plurality of wire members through a path restricting section provided on a moving path, which is a path of the plurality of wire members that extends along a first direction passing through the predetermined hole die up to the predetermined take-up unit, the plurality of wire members being braided into the braided wire from a predetermined convergence position before passing through the path restricting section; and (c) a step of winding up the braided wire after passing through the path restricting section using the predetermined take-up unit, wherein the path restricting section used in the step (b) is capable of performing a second direction restriction so that movement of the braided wire in the second direction, which is perpendicular to the first direction, falls within a predetermined restriction width from an ideal center position that coincides with a winding position of the braided wire by the predetermined take-up unit, and the path restricting section is provided at a formation height in the first direction in the vicinity of a braiding pitch length of the braided wire from the predetermined convergence position.

A braided wire manufacturing apparatus according to a second aspect of the invention is an apparatus that, after obtaining a braided wire by braiding a plurality of wire members, winds up the braided wire using a predetermined take-up unit, the apparatus including: a predetermined wire feeding mechanism configured to feed the plurality of wire members toward a predetermined hole die; a path restricting section provided on a moving path which is a path of the plurality of wire members that extends along a first direction passing through the predetermined hole die up to the predetermined take-up unit, the plurality of wire members being braided into the braided wire from a predetermined convergence position before passing through the path restricting section; and the predetermined take-up unit configured to wind up the braided wire after passing through the path restricting section, wherein the path restricting section is capable of performing a second direction restriction so that movement of the braided wire in the second direction, which is perpendicular to the first direction, falls within a predetermined restriction width from an ideal center position that coincides with a winding position by the predetermined take-up unit, and the path restricting section is set at a formation height in the first direction in the vicinity of a braiding pitch length of the braided wire from the predetermined convergence position.

The invention according to a third aspect involves the braided wire manufacturing apparatus according to the second aspect, wherein the plurality of wire members include a predetermined number of wire members, the wire feeding mechanism is provided in a number corresponding to the predetermined number of wire members and has bobbins in the predetermined number that each rotationally move, the predetermined number of wire members being unwound from the predetermined number of bobbins toward the predetermined hole die, the predetermined number is "44", the plurality of wire members are each a wire member that is composed of four tin coated annealed copper wires and has a diameter of 0.26 mm, and the predetermined restriction width is less than 4 mm.

Advantageous Effects of Invention

The path restricting section used in the step (b) of the manufacturing method of the present invention according to the first aspect has a first feature of being capable of performing the second direction restriction so that the movement of the braided wire in the second direction, which is perpendicular to the first direction, falls within the predetermined restriction width from the aforementioned ideal center position.

The present invention according to the first aspect, with such a first feature, can suppress braid distortion due to displacement of the braided wire in the second direction, by setting the aforementioned predetermined restriction width within a range in which the displacement in the second direction from the ideal center position does not cause braid distortion.

Furthermore, the present invention according to the first aspect has a second feature that the path restricting section is provided at a formation height in the first direction in the vicinity of the braiding pitch length of the braided wire from the predetermined convergence position, thereby allowing the second direction restriction by the path restricting section to be performed most effectively. Therefore, it is possible to suppress braid distortion reliably.

In the braided wire manufacturing apparatus of the present invention according to the second aspect, the path restricting section has a first feature of being capable of performing the second direction restriction so that the movement of the braided wire in the second direction perpendicular to the first direction falls within the predetermined restriction width from the aforementioned ideal center position.

The present invention according to the second aspect, with such a first feature, can suppress braid distortion due to displacement of the braided wire in the second direction, by setting the aforementioned predetermined restriction width within a range in which the displacement in the second direction from the ideal center position does not cause braid distortion.

Furthermore, the present invention according to the second aspect has a second feature that the path restricting section is provided at a formation height in the first direction in the vicinity of the braiding pitch length of the braided wire from the predetermined convergence position, thereby allowing the second direction restriction by the path restricting section to be performed most effectively. Therefore, it is possible to suppress braid distortion reliably.

The manufacturing apparatus of the present invention according to the third aspect enables a braided wire to be produced with high accuracy using a predetermined number of wire members and the wire feeding mechanism with the aforementioned features.

Other objects, features, aspects, and advantages of the invention will become more apparent from the following detailed description and the accompanying drawings.

DESCRIPTION OF EMBODIMENTS

Overall Configuration

Hereinafter, a braided wire manufacturing method and a braided wire manufacturing apparatus according to an embodiment of the invention are described.

Figure 1:
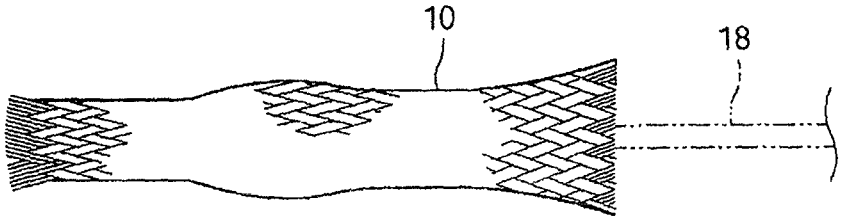
FIG. 1 is a schematic view showing a braided wire obtained by braiding a plurality of wire members.

FIG. 1 is a schematic view showing a braided wire 10 obtained by braiding a plurality of wire members. The braided wire 10 is formed by braiding a plurality of (for example, 44) conductive wires 12 (which will be explained below) as a plurality of wire members into a hollow tubular shape. As the conductive wires, copper wires, copper alloy wires, or the like are used. This braided wire 10 can be expanded in such a manner as to stretch the braided wire 10. An electric wire 18 such as a power line is inserted into the thus expanded braided wire 10, so that the braided wire 10 covers the electric wire 18. In this way, the braided wire 10 electromagnetically shields the electric wire 18. As has been mentioned above, the braided wire 10 is used, for example, as a shielding member that covers the electric wire 18 provided between MG and INV in HEVs/EVs.

Figure 2:
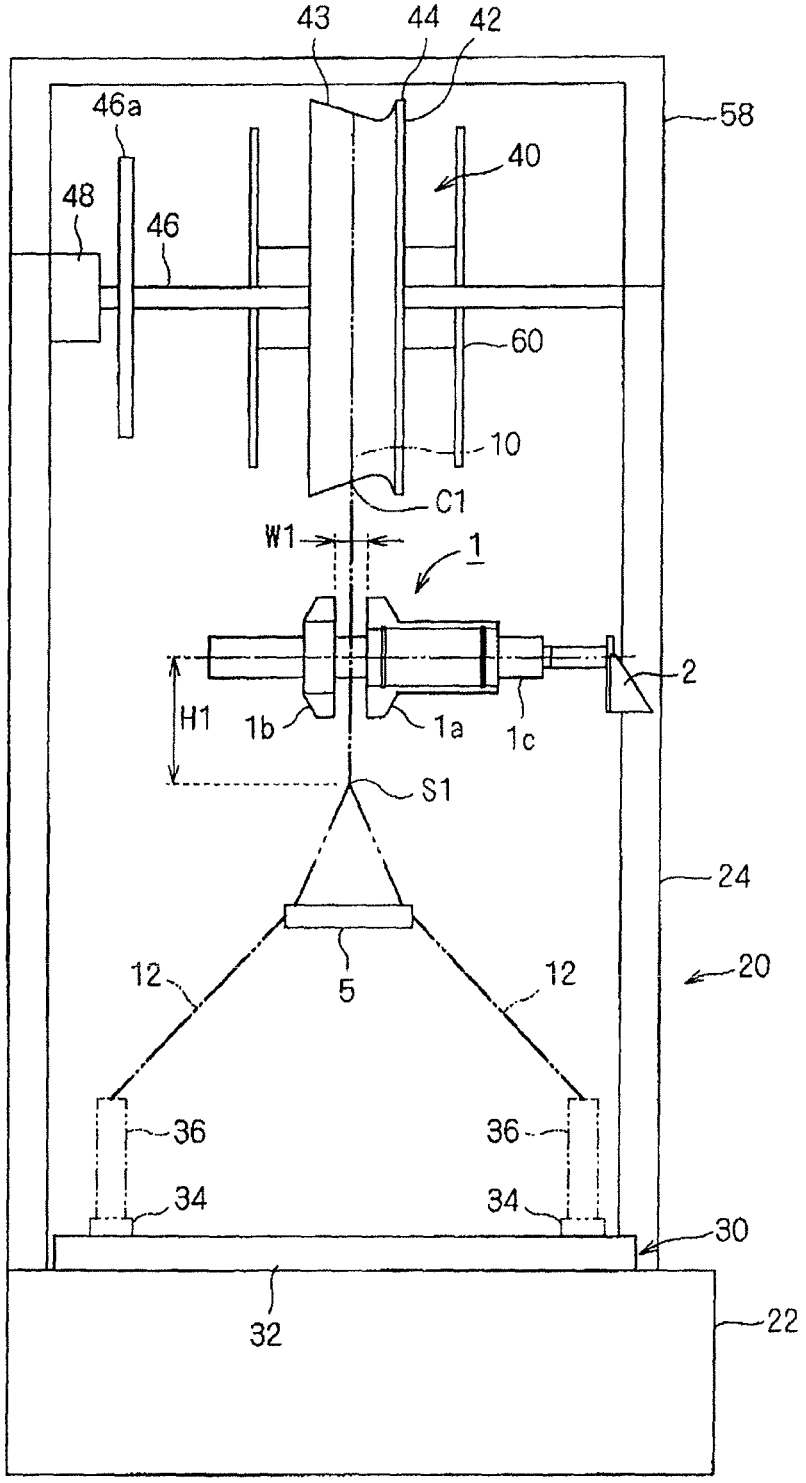
FIG. 2 is a front view showing a braided wire manufacturing apparatus according to an embodiment of the invention.
Figure 3:
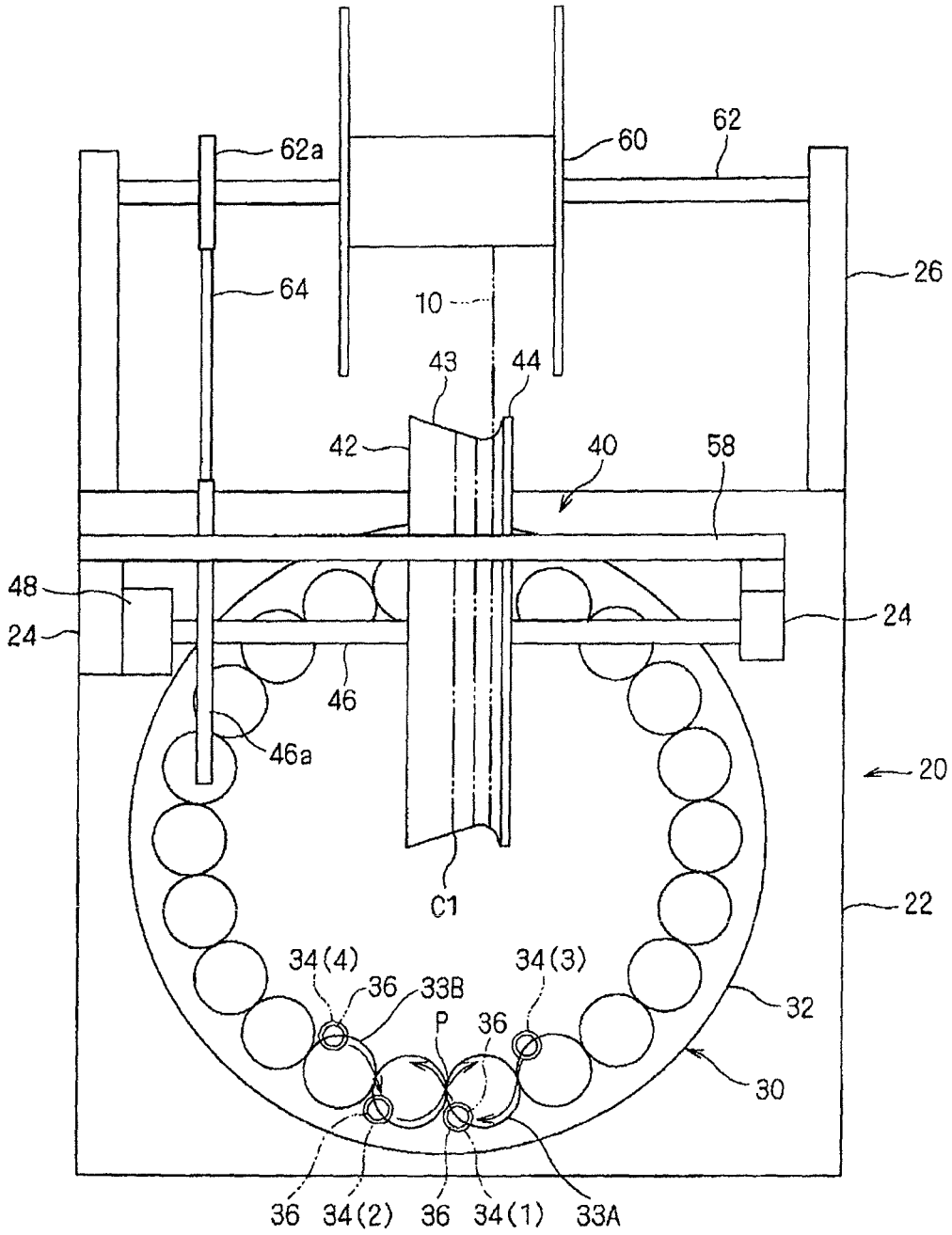
FIG. 3 is a plan view showing the aforementioned braided wire manufacturing apparatus.

FIG. 2 is a front view showing a braided wire manufacturing apparatus 20 of this embodiment in which a capstan unit 40 is integrated. FIG. 3 is a plan view showing the braided wire manufacturing apparatus 20.

The braided wire manufacturing apparatus 20 is an apparatus for manufacturing the braided wire 10 by braiding a plurality of conductive wires 12, and mainly includes a wire feeding mechanism 30, a hole die 5, a guide roller 1, the capstan unit 40, and a take-up storage section 60.

The wire feeding mechanism 30 is configured to be capable of feeding out the plurality of conductive wires 12 in such a manner as to form a tubular braid. The wire feeding mechanism 30 herein includes a traveling base 32 provided on an apparatus base 22, a plurality of traveling sections 34 provided so as to be capable of traveling on the traveling base 32, and bobbins 36 provided respectively for the plurality of traveling sections 34. It should be noted that, in the following description, FIG. 3, etc., the plurality of traveling sections 34 may be referred to as a traveling section 34(1), 34(2), 34(3), and 34(4) in order to distinguish them.

The traveling base 32 is formed into a disc shape, and has two traveling paths 33A and 33B on its upper surface. The traveling paths 33A and 33B are each formed as a traveling path having semi-arcuate portions that are continuous in a ring shape so as to depict a sine wave. Further, the two traveling paths 33A and 33B intersect each other, with their convex portions on the outer circumference side and their convex portions on the inner circumferential side respectively matching each other (in terms of the sine wave, in a state of being displaced with respect to each other by a half cycle).

The traveling sections 34 are configured to be capable of rotatably supporting the bobbins 36 on which the conductive wires 12 are wound and carried. While the conductive wires 12 unwound from the bobbins 36 are braided into a tubular braid by the traveling of the traveling sections 34, after the conductive wires 12 have passed through the hole die 5 and the guide roller 1, they are wound up as the braided wire 10 by the capstan unit 40.

That is, half of the traveling sections 34 are provided so as to be capable of traveling along one traveling path 33A, whereas the remaining half of the traveling sections 34 are provided so as to be capable of traveling along the other traveling path 33B. A travel driving mechanism using a motor, a traveling belt, or the like is integrated in the traveling base 32. The travel driving mechanism drives the traveling sections 34 to travel along the respective traveling paths 33A and 33B. Specifically, in the one traveling path 33A, the plurality of traveling sections 34 are driven to travel at intervals in one rotational direction around the traveling base 32, whereas in the other traveling path 33B, the plurality of traveling sections 34 are driven to travel at intervals in the other rotational direction around the traveling base 32. The traveling sections 34 travel rotatively in opposite directions to each other, while switching their inner and outer circumferential positions on the respective traveling paths 33A and 33B. This shall be explained by looking at one point P in FIG. 3, at which the traveling paths 33A and 33B intersect each other: After the traveling section 34(1) traveling along the traveling path 33A has passed through the point P clockwise from the outer circumferential side toward the inner circumferential side, the traveling section 34(2) traveling along the traveling path 33B passes through the point P counterclockwise from the outer circumferential side toward the inner circumferential side. Thereafter, the traveling section 34(3) traveling along the traveling path 33A passes through the point P clockwise from the outer circumferential side toward the inner circumferential side. Further thereafter, the traveling section 34(4) traveling along the traveling path 33B passes through the point P counterclockwise from the outer circumferential side toward the inner circumferential side. In this way, while the conductive wires 12 unwound from the bobbins 36 supported by the traveling sections 34 that travel along the traveling path 33A and the conductive wires 12 unwound from the bobbins 36 supported by the traveling sections 34 that travel along the traveling path 33B are arranged so as to switch their positions between the inner circumferential side and the outer circumferential side, they are supplied from the outer circumferential side of a predetermined axis so as to be collected ideally on the center axis of the traveling paths 33A and 33B and braided into a tubular braid.

As mentioned above, the braided wire manufacturing apparatus 20 allows the plurality of conductive wires 12 to pass through the hole die 5 and the guide roller 1, and finally to be wound up as the braided wire 10 by the capstan unit 40 so as to be wound and carried on the take-up storage section 60. The hole die 5 is provided at such a position that its center coincides with the center of the unwinding position from the plurality of bobbins 36 (on the center axis of the traveling paths 33A and 33B) in plan view.

That is, the braided wire manufacturing apparatus 20 of this embodiment is an apparatus in which the plurality of conductive wires 12 fed from the wire feeding mechanism 30 are braided into the braided wire 10 from a convergence position S1 after passing through the hole die 5, and after passing through the guide roller 1, the braided wire 10 is wound up by the capstan unit 40. The apparatus performs the following steps (a) to (c).

(a) A step of feeding the plurality of conductive wires 12 from the wire feeding mechanism 30 (predetermined wire feeding mechanism) to the hole die 5, (b) a step of passing the plurality of conductive wires 12 along the guide roller 1 (path restricting section) provided on a moving path which is a path of the plurality of conductive wires 12 that extends along a perpendicular direction (first direction) passing through the hole die 5 up to the capstan unit 40, the braiding of the plurality of conductive wires 12 as the braided wire 10 being started from the convergence position S1 above the hole die 5 before passing along the guide roller 1, and (c) a step of winding up the braided wire 10 that has passed along the guide roller 1 using the capstan unit 40 (predetermined take-up unit).

In this way, the capstan unit 40 is provided above the wire feeding mechanism 30, the hole die 5, and the guide roller 1, and the take-up storage section 60 is provided laterally of the capstan unit 40.

The convergence position S1 can be set at an intended height from the hole die 5 by setting the size of the (circular) opening of the hole die 5 through which the plurality of conductive wires 12 pass to a desired diameter.

The capstan unit 40 is configured to be capable of winding up the braided wire 10, after being braided, and sending the braided wire 10 thus wound to the take-up storage section 60, so that the conductive wires 12 are drawn out of the bobbins 36 continuously.

The capstan unit 40 includes a capstan roller 42.

The capstan roller 42 having a disc shape overall has a tapered outer circumferential surface 43 along which its diameter is sequentially reduced from one side toward the other side, and a flange section 44 projecting toward the outer circumferential side is formed at the end on its smaller diameter side. In this description, the tapered outer circumferential surface 43 has a portion at which the diameter slightly increases that extends from the portion at which the diameter is smallest toward the flange section 44, which however is not essential.

The capstan roller 42 is rotatably supported by a support 24 provided on the apparatus base 22 above the traveling base 32. In such a supported state, a rotation shaft 46 of the capstan roller 42 is provided along the horizontal direction (second direction), and is orthogonal to the perpendicular direction that is the winding direction of the braided wire 10. Further, an extended line of the center axis of the traveling paths 33A and 33B comes into contact with the tapered outer circumferential surface 43 at a position C1 (take-up starting point C1) located on the larger diameter side with respect to the portion of the tapered outer circumferential surface 43 at which the diameter is smallest in the axis direction of the capstan roller 42. This allows the braided wire 10 braided into a tubular shape to be drawn directly upward as it is, so as to be wound from the take-up starting point C1 that is a portion on the larger diameter side of the tapered outer circumferential surface 43.

Accordingly, the take-up starting point C1 of the capstan unit 40 is located at the ideal center position of the braided wire 10, which will be explained below.

Further, a rotation driving mechanism 48 such as a motor is provided at one end of the rotation shaft 46 of the capstan roller 42. The rotation driving mechanism 48 drives the capstan roller 42 to rotate in a direction to wind up the braided wire 10.

It should be noted that another capstan for applying additional tension to the braided wire 10, an accumulator for absorbing an extra length of the braided wire 10, or the like may be integrated in the braided wire manufacturing apparatus 20.

The take-up storage section 60 is formed into a reel shape so as to be capable of winding and carrying the braided wire 10 and is rotatably supported by a support frame 26 at a lateral position of the capstan roller 42. Further, a ring belt 64 is wound and hung around a pulley 46*a* attached to the rotation shaft 46 of the capstan roller 42 and a pulley 62*a* attached to a rotation shaft 62 of the take-up storage section 60, so that the rotation of the rotation shaft 46 is transmitted to the rotation shaft 62 via the ring belt 64. Thus, the take-up storage section 60 is configured to rotate in synchronization with the capstan roller 42.

As the capstan roller 42 and the take-up storage section 60 are rotated by the rotation driving mechanism 48, the braided wire 10 after being braided is wound up by the capstan roller 42, and is passed to the take-up storage section 60 so as to be wound and carried on the take-up storage section 60.

The braided wire 10 that has reached the take-up starting point C1 of the tapered outer circumferential surface 43 is wrapped multiple times (for example, twice) around the tapered outer circumferential surface 43 in a region from the aforementioned reached portion up to the flange section 44, and is drawn outwardly from the portion wrapped around the flange section 44 so as to be guided to the take-up storage section 60. The braided wire 10 is wrapped around the tapered outer circumferential surface 43 multiple times, thereby reducing the slip between the tapered outer circumferential surface 43 and the braided wire 10, so that the rotational driving force of the capstan roller 42 is more reliably transmitted as a force to wind up the braided wire 10. When the braided wire 10 is wrapped around the tapered outer circumferential surface 43, the braided wire 10 is wrapped into a spiral shape so that the circumferentially wound portions of the braided wire 10 do not interfere with each other.

Guide Roller 1

As shown in FIG. 2, the guide roller 1 is provided on the moving path of the braided wire 10, above the pathway of the hollow portion of the hole die 5 and immediately below the winding position C1 of the capstan unit 40, at a guide height H1 from the convergence position S1 of the plurality of conductive wires 12.

The guide roller 1 is composed of a roller body 1*a*, a roller flange section 1*b*, and shaft section 1*c*. The guide roller 1 is positioned in the horizontal direction (second direction) so that the braided wire 10 passes through a restricting region having a guide width W1 between the respective flange sections of the roller body 1*a* and the roller flange section 1*b*.

The shaft section 1*c* is rotatably provided on a bracket 2. The rotation of the shaft section 1*c* within the aforementioned restricting region smoothens the movement of the braided wire 10 due to the rotation of the shaft section 1*c*, so that the displacement of the braided wire 10 in the horizontal direction is restricted without impeding the movement of the braided wire 10 to the capstan unit 40.

The guide width W1 is set to about 10 mm to 12 mm for a braided wire 10 having a width in production of about 10 mm, thus restricting displacement of the braided wire 10 in the horizontal direction to about 2 mm at a maximum to the left and right sides.

Figure 4:
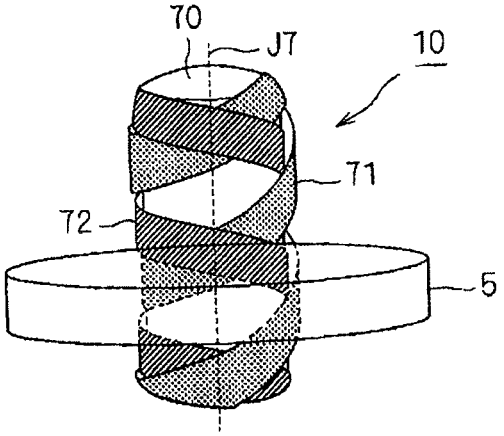
FIG. 4 is an explanatory diagram (No. 1) schematically illustrating a braiding structure of the braided wire.

FIG. 4 is an explanatory diagram schematically showing the braiding structure of the braided wire 10. The braided wire 10 is formed by braiding a first wire member group 71 (which corresponds to a group consisting of the conductive wires 12 unwound from the bobbins 36 supported by the traveling sections 34 traveling along the traveling path 33A in FIG. 3) and a second wire member group 72 (which corresponds to a group consisting of the conductive wires 12 unwound from the bobbins 36 supported by the traveling sections 34 traveling along the traveling path 33B in FIG. 3), with the center axis of braided area J7 at the center. It should be noted that 70 denotes an imaginary object to be covered.

Accordingly, a braided wire 10 with high accuracy and without braid distortion can be obtained ideally when the center axis of braided area J7 coincides with the ideal center position (which coincides with both the take-up starting point C1 of the capstan unit 40 and the center position of the hole die 5).

On the other hand, when the center axis of braided area J7 is displaced from the ideal center position, that is, for example, assuming the state shown in FIG. 4 as the state where the center axis of braided area J7 and the ideal center position coincide with each other, when the center axis of braided area J7 is displaced toward the left or right side, a difference occurs between the first wire member group 71 and the second wire member group 72 in moving distance up to the convergence position S1 (one group moves more and the other group moves less). Therefore, a difference occurs in braiding ratio, as a result of which braid distortion occurs in the braided wire 10. It should be noted that the braiding ratio means an increment of the first wire member group 71 or the second wire member group 72 which is necessary in order to yield the braided wire 10 with a predetermined wire length. For example, when 102 mm of the first wire member group 71 is necessary for 100 mm of the braided wire 10, the braiding ratio is 2% (2/100).

As a probable cause of displacement of the center axis of braided area J7 in the horizontal direction, there is a tendency that the tension is not equally applied to all of the plurality of (44) bobbins 36. Further, there also may be an adverse effect of that the bobbins 36 each have a somewhat different unwinding position, thereby having a variable path line length, or guide rollers for unwinding that are provided adjacent to the bobbins 36 wear.

The braided wire manufacturing apparatus 20 of this embodiment can suppress the displacement in the horizontal direction of the center axis of braided area J7 of the braided wire 10 (width in production=10 mm) from the ideal center position to 2 mm or less at maximum to the left and right sides by providing the guide roller 1 between the hole die 5 and the capstan unit 40 so as to force the braided wire 10 to pass through the restricting region having the guide width W1 (=12 mm).

Further, the applicant has confirmed that a braided wire 10 without braid distortion can be obtained when the displacement in the horizontal direction from the ideal center position is reduced to less than 4 mm at maximum to the left and right sides, if the braided wire 10 is the aforementioned type of braided wire produced under specific experimental conditions, that is, a braided wire classified as "44 carriers, four ends per carrier, TA, 0.26 mm" is produced at a braid pitch PT of 175 mm, with each of the bobbins 36 rotated at a rotation rate of 8 rpm.

Further, the guide roller 1 is formed at a formation height of the braid pitch PT from the convergence position S1 of the braided wire 10 at which the braiding of the plurality of conductive wires 12 is started. That is, the guide height H1 that is the distance in the perpendicular direction from the convergence position S1 to the center axis of the shaft section 1*c* of the guide roller 1 is set to the braid pitch PT. In the case of the aforementioned type of braided wire, the guide height H1 is set at a position of 175 mm from the convergence position S1 and 200 mm from the hole die 5.

Figure 5:
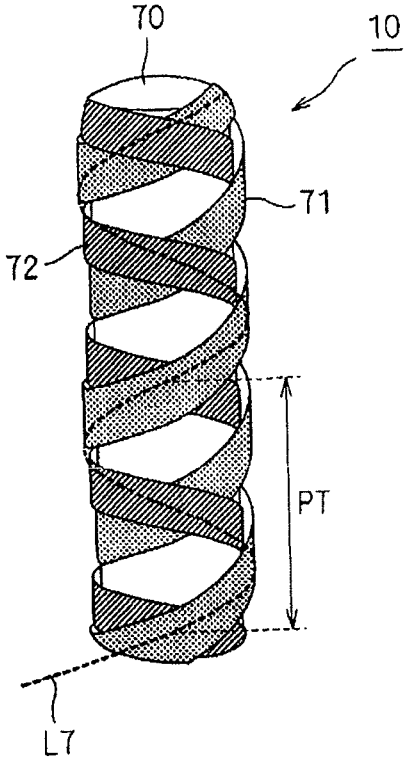
FIG. 5 is an explanatory diagram (No. 2) schematically illustrating a braiding structure of the braided wire.

FIG. 5 is an explanatory diagram schematically showing the braiding structure of the braided wire 10. Looking at the first wire member group 71 in this figure, the first wire member group 71 is wound around the imaginary object to be covered 70 along a braiding curve L7. As shown by the braiding curve L7, the braid pitch PT is the distance in the perpendicular direction that is required for the first wire member group 71 to make one revolution around the imaginary object to be covered 70. In FIG. 5, the braid pitch PT is shown for the braiding curve L7 of the first wire member group 71. However, the second wire member group 72 also has a braid pitch PT of the same length.

Thus, the braided wire manufacturing apparatus 20 of this embodiment has a first feature that the guide roller 1 used in the aforementioned step (b) of the manufacturing method is capable of performing a horizontal direction restriction so that the movement of the braided wire 10 in the horizontal direction falls within a predetermined restriction width (2 mm at maximum to the left and right sides) from the aforementioned ideal center position.

Accordingly, even if unevenness in tension occurs among the conductive wires 12 fed from the respective bobbins 36, it is possible to suppress the displacement of the center axis of braided area J7 from the aforementioned ideal center position to 2 mm or less.

In this way, with such a first feature, the manufacturing method using the braided wire manufacturing apparatus 20 can suppress braid distortion due to the displacement in the horizontal direction of the braided wire 10, by setting the aforementioned predetermined restriction width (2 mm) to be less than the displacement amount (4 mm) in the horizontal direction from the ideal center position which involves a possibility of causing braid distortion.

Furthermore, the braided wire manufacturing apparatus 20 of this embodiment has a second feature that the guide roller 1 used in the aforementioned step (b) of the manufacturing method is provided at a height of the braid pitch PT in the perpendicular direction from the convergence position S1.

The applicant of the subject application has confirmed that, when the distance from the convergence position S1 to the guide roller 1 is shifted from the braid pitch PT, it is made difficult to exert the advantageous effects of the aforementioned horizontal direction restriction, and thus braid distortion may occur.

Accordingly, with such a second feature, the manufacturing method using the braided wire manufacturing apparatus 20 allows the horizontal direction restriction to be performed by the guide roller 1 most effectively, and therefore can suppress braid distortion of the braided wire 10.

It should be noted that, as long as the guide height H1 of the guide roller 1 is in the vicinity of the braid pitch PT, the second feature is considered to be substantially achieved.

As a result, the manufacturing method using the braided wire manufacturing apparatus 20 of this embodiment makes it possible to obtain a braided wire 10 with high accuracy without braid distortion. Therefore, when being cut in a processing stage, the braided wire 10 is prevented from having an angled cut section. Thus, when the end of the braided wire is fixed to a grounding ring member or the like, for example, by crimping, there is no increase in contact resistance or deterioration in fixation strength caused between the two.

Particularly, it is possible to suppress the braid distortion of the aforementioned type of the braided wire 10 (braided wire classified as "44 carriers, four ends per carrier, TA, 0.26 mm") effectively.

That is, when 44 conductive wires 12 are unwound from 44 bobbins 36, where the conductive wires 12 are of "four ends per carrier, TA, 0.26 mm", the braided wire 10 can be manufactured with high accuracy.

Although the guide roller 1 performs the horizontal direction restriction along the direction in which the rotation shaft 46 of the capstan unit 40 is formed, it is also possible to perform additional horizontal direction restriction along a direction other than the direction in which the rotation shaft 46 is formed.

It should be noted that embodiments of the present invention can be appropriately modified or omitted within the scope of the invention.

This invention has been described above in detail, which are intended to be illustrative in all aspects, rather than restrictive. It is understood that various modifications which have not been mentioned above can be made without departing from the scope of the invention.

REFERENCE SIGNS LIST

1 Guide Roller
5 Hole Die
10 Braided Wire
12 Conductive Wire
20 Braided Wire Manufacturing Apparatus
30 Wire Feeding Mechanism
36 Bobbin
40 Capstan Unit
42 Capstan Roller

What is claimed is:

1. A braided wire manufacturing method in which, after obtaining a braided wire by braiding a plurality of wire members, the braided wire is wound up using a take-up unit, the method comprising:

feeding the plurality of wire members from a wire feeding mechanism toward a hole die having a circular opening;

passing the plurality of wire members through a path restricting section provided on a moving path which is a path of the plurality of wire members that extends along a first direction passing through the hole die up to the take-up unit, the plurality of wire members being braided into the braided wire at a convergence position before passing through the path restricting section, the convergence position being defined at a predetermined height above the hole die, and set based upon a size of the circular opening of the hole die; and winding up the braided wire after passing through the path restricting section using the take-up unit, wherein:

the path restricting section is capable of performing a second direction restriction so that movement of the braided wire in a second direction, which is perpendicular to the first direction, falls within a predetermined restriction width from an ideal center position that coincides with a winding position of the braided wire by the take-up unit, and the path restricting section is provided at a formation height in the first direction at substantially a braiding pitch length of the braided wire above the convergence position.

2. A braided wire manufacturing apparatus that, after obtaining a braided wire by braiding a plurality of wire members, winds up the braided wire using a take-up unit, the apparatus comprising:

a wire feeding mechanism configured to feed the plurality of wire members toward a hole die having a circular opening;

a path restricting section provided on a moving path which is a path of the plurality of wire members that extends along a first direction passing through the hole die up to the take-up unit, the plurality of wire members being braided into the braided wire at a convergence position before passing through the path restricting section, the convergence position being defined at a predetermined height above the hole die, and set based upon a size of the circular opening of the hole die; and the take-up unit configured to wind up the braided wire after passing through the path restricting section, wherein the path restricting section is capable of performing a second direction restriction so that movement of the braided wire in a second direction, which is perpendicular to the first direction, falls within a predetermined restriction width from an ideal center position that coincides with a winding position by the take-up unit, and the path restricting section is set at a formation height in the first direction at substantially a braiding pitch length of the braided wire above the convergence position.

3. The braided wire manufacturing apparatus according to claim 2, wherein:

the plurality of wire members include a predetermined number of wire members, the wire feeding mechanism is provided in a number corresponding to the predetermined number of wire members and has bobbins in the predetermined number that each rotationally move, the predetermined number of wire members being unwound from the predetermined number of bobbins toward the hole die, the predetermined number is "44", each of the plurality of wire members is a wire member that is composed of four tin coated annealed copper wires and has a diameter of 0.26 mm, and the predetermined restriction width is less than 4 mm.

* * * * *